US008662936B2

(12) United States Patent
Chung et al.

(10) Patent No.: US 8,662,936 B2
(45) Date of Patent: Mar. 4, 2014

(54) USB FEMALE CONNECTOR

(71) Applicant: Kuang Ying Computer Equipment Co., Ltd., New Taipei (TW)

(72) Inventors: Hsuan-Ho Chung, New Taipei (TW); Yu-Hung Lin, New Taipei (TW); Chih-Ming Hsu, New Taipei (TW)

(73) Assignee: Kuang Ying Computer Equipment Co., Ltd., New Taipei (TW)

( * ) Notice: Subject to any disclaimer, the term of this patent is extended or adjusted under 35 U.S.C. 154(b) by 0 days.

(21) Appl. No.: 13/664,425

(22) Filed: Oct. 31, 2012

(65) Prior Publication Data

US 2013/0130521 A1 May 23, 2013

(30) Foreign Application Priority Data

Nov. 18, 2011 (TW) ..... 100221842 A

(51) Int. Cl.
*H01R 24/00* (2011.01)

(52) U.S. Cl.
USPC ..... 439/660; 439/607.35; 439/941

(58) Field of Classification Search
USPC ..... 439/607.31–607.4, 660, 941
See application file for complete search history.

(56) References Cited

U.S. PATENT DOCUMENTS

| | | | | |
|---|---|---|---|---|
| 8,444,439 | B2 * | 5/2013 | Cao et al. | 439/607.35 |
| 8,454,387 | B2 * | 6/2013 | Peng et al. | 439/607.35 |
| 8,475,211 | B2 * | 7/2013 | Wang et al. | 439/607.38 |
| 2010/0240255 | A1 * | 9/2010 | He et al. | 439/607.35 |
| 2013/0252466 | A1 * | 9/2013 | Chen | 439/607.35 |

* cited by examiner

*Primary Examiner* — Khiem Nguyen
(74) *Attorney, Agent, or Firm* — Leong C. Lei

(57) ABSTRACT

The USB female connector contains an insulating base and a shielding casing enclosing the insulating base. On the insulating base, there is mainly a ground terminal having a flat ground contact section at an end on the insulating base. From the ground contact section, the ground terminal is extended away from the insulating base and forked into a first ground extension section, a second ground extension section, and a third ground extension section. Through the forked first, second, and third ground extension sections, the high-frequency crosstalk problem is effectively resolved.

14 Claims, 8 Drawing Sheets

USB FEMALE CONNECTOR

(a) TECHNICAL FIELD OF THE INVENTION

The present invention generally relates to USB female connectors, and especially relates to a USB female connector immune from the crosstalk problem resulted from high-frequency signal.

(b) DESCRIPTION OF THE PRIOR ART

USB connectors are widely applied and, especially in recent days, the transmission frequency of USB connectors is increased significantly.

Crosstalk refers to the interference between signals on adjacent communication channels. When the transmission distance is long, the adjacent channels are too close, or the difference in signal intensities is too great, the possibility of occurrence of crosstalk also increases. For high-frequency connections, crosstalk is major factor affecting the high-frequency transmission's differential signals. More specifically, during high-frequency transmission, unreliable signal transmission would occur due to the crosstalk between the differential signal pairs, or between the differential signal and signal pairs. Usually, a part of the terminals of electronic connectors are grounded to isolate crosstalk between the terminals.

Therefore, how to resolve the crosstalk problem during high-frequency transmission is a main concern to the present inventor and other manufacturers for the USB connectors.

SUMMARY OF THE INVENTION

Therefore a novel USB female connector is provided herein so as to resolve the crosstalk problem resulted from high-frequency signal transmission.

A major objective of the present invention is that the crosstalk on a first, second, third, and fourth differential signal terminals from a first and second signal terminals on the USB female connector is effectively resolved through a first, second, and third ground extension sections forked from a ground terminal. And this objective is achieved under the same space limitation.

Another objective of the present invention is that reduced production time and enhanced efficiency are achieved by integrally forming an opening at an end of a shielding casing of the USB female connector.

To achieve the objectives, the USB female connector contains an insulating base and, on the insulating base, a ground terminal, a first signal terminal, a second signal terminal, a fourth ground terminal, a first differential signal terminal, a second differential signal terminal, a first power terminal, a third differential signal terminal, and a fourth differential signal terminal. The ground terminal has a flat ground contact section 111 at an end on the insulating base. From the ground contact section, the ground terminal is extended away from the insulating base and forked into a first ground extension section, a second ground extension section, and a third ground extension section. Through the forked first, second, and third ground extension sections, the high-frequency crosstalk problem is effectively resolved. In addition, the insulating base is enclosed in a shielding casing, and an opening is integrally formed at an end of the shielding casing away from the insulating base. The production process therefore takes less production time, and is more efficient. With the present invention, the crosstalk between the differential signal pairs, or between the differential signal and signal pairs during high-frequency transmission, and the resulted unreliable signal transmission are as such resolved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
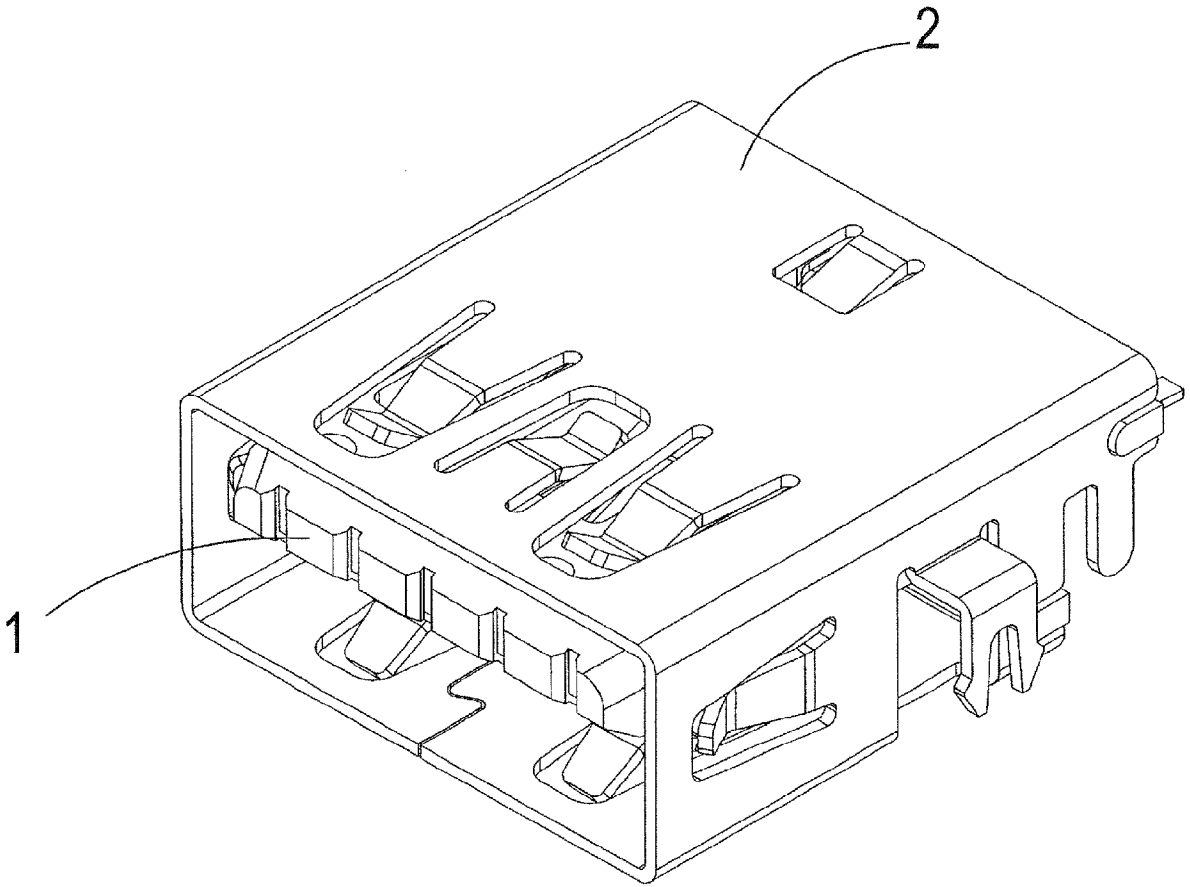
FIG. 1 is a perspective diagram showing a USB female connector according a first embodiment of the present invention in the style of continuous bending and extension.
Figure 2:
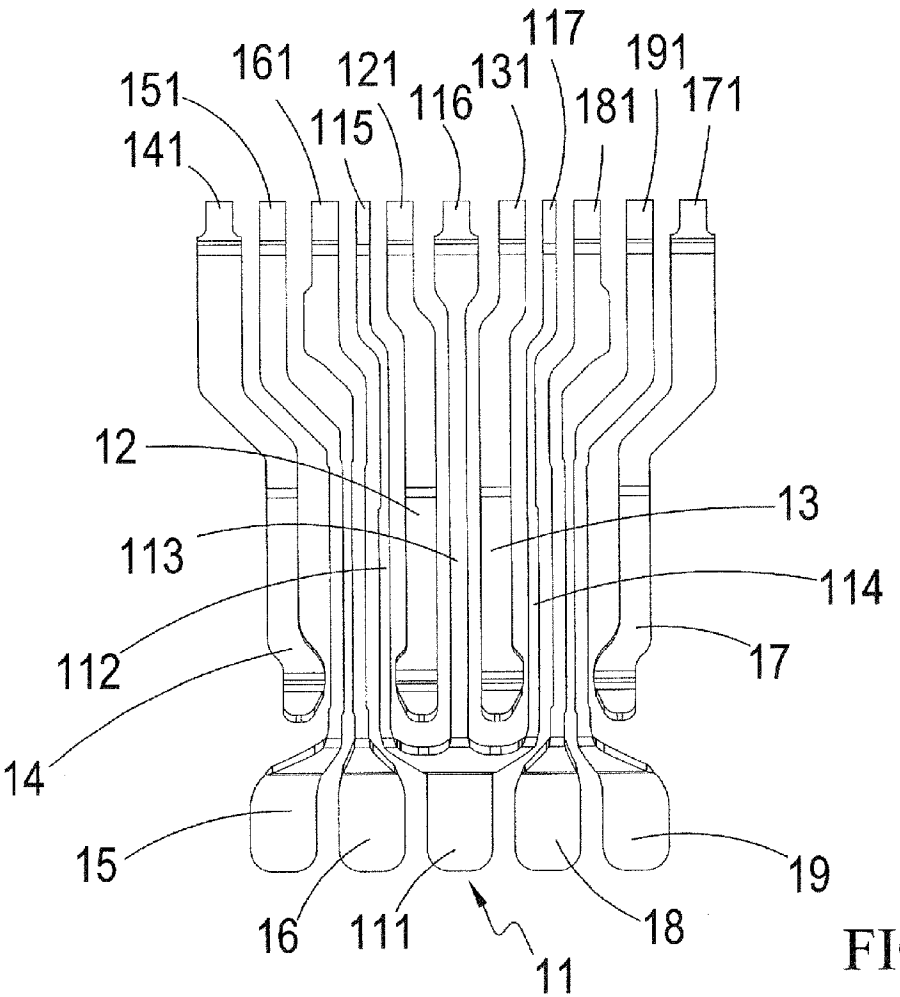
FIG. 2 is a schematic diagram showing the terminal layout of the USB female connector of FIG. 1.
Figure 2A:
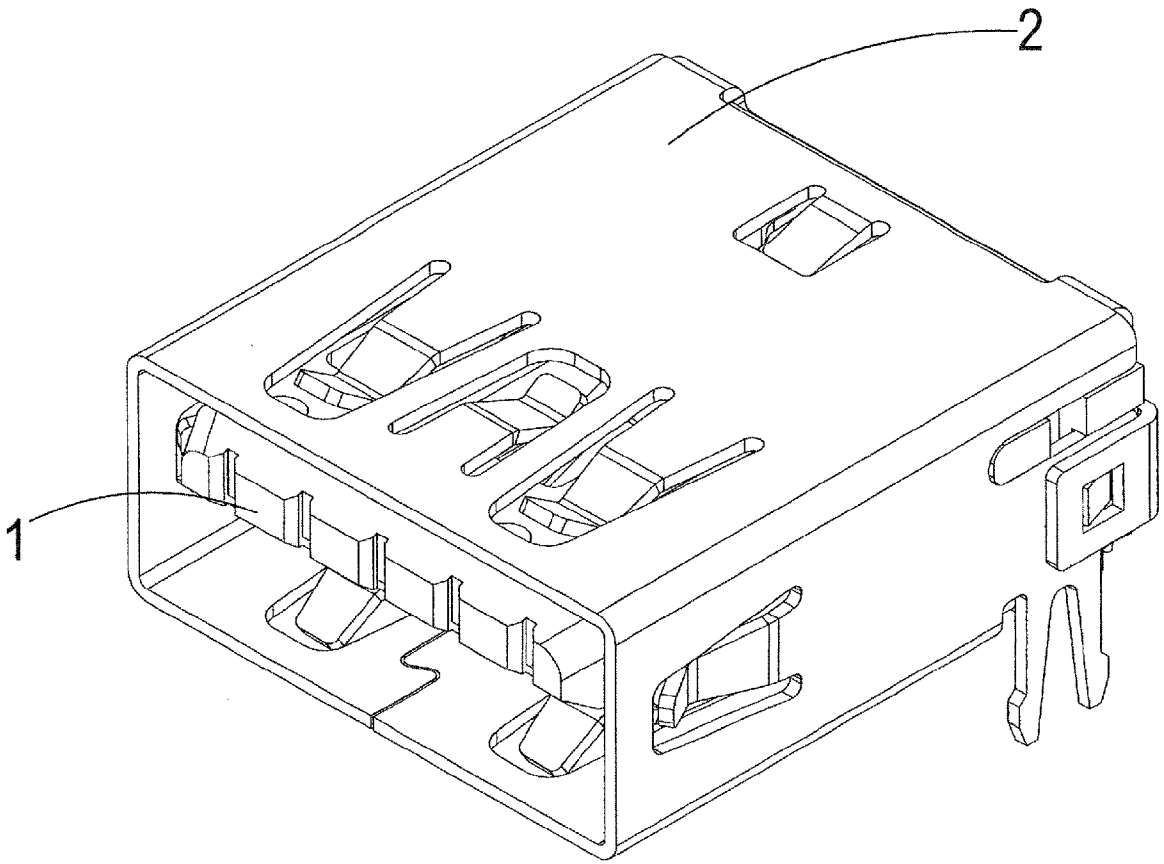
FIG. 2A is a perspective diagram showing a USB female connector according a first embodiment of the present invention in the style of downward bending and extension.

As shown in FIGS. 1, 2, and 2A, a USB female connector according to a first embodiment of the present invention contains the following components.

There is an insulating base 1 that can be a printed circuit board (PCB), a 3D circuit board, or an insulating plastic member.

There is a metallic ground terminal 11 on the insulating base 1. The ground terminal 11 has a flat ground contact section 111 at an end on the insulating base 1. From the ground contact section 111, the ground terminal 11 is extended away from the insulating base 1 and forked into a first ground extension section 112, a second ground extension section 113, and a third ground extension section 114. The first, second, and third ground extension sections 112, 113, and 114 are further extended away from the ground contact section 111 into a first ground soldering section 115, a second ground soldering section 116, and a third ground soldering section 117, respectively.

There is a metallic first signal terminal 12 on the insulating base 1 between the first and second ground extension sections 112 and 113. The first signal terminal 12 has a first signal soldering section 121 at an end between the first and second ground soldering sections 115 and 116.

There is a metallic second signal terminal 13 on the insulating base 1 between the second and third ground extension sections 113 and 114. The second signal terminal 13 has a second signal soldering section 131 at an end between the second and third ground soldering sections 116 and 117.

There is a metallic fourth ground terminal 14 on the insulating base 1 at the side and parallel to the first signal terminal 12. The fourth ground terminal 14 has a fourth ground soldering section 141 at an end parallel to the first ground soldering section 115.

There is a metallic first differential signal terminal 15 on the insulating base 1 between the first ground extension section 112 and the fourth ground terminal 14. The first differential signal terminal 15 has a first differential signal soldering section 151 at an end between the fourth ground soldering section 141 and the first ground soldering section 115.

There is a metallic second differential signal terminal 16 on the insulating base 1 between the first ground extension section 112 and the first differential signal terminal 15. The second differential signal terminal 16 has a second differential signal soldering section 161 at an end between the first differential signal soldering section 151 and the first ground soldering section 115.

There is a metallic first power terminal 17 on the insulating base 1 at the side and parallel to the second signal terminal 13. The first power terminal 17 has a first power soldering section 171 at an end parallel to the third ground soldering section 117.

There is a metallic third differential signal terminal 18 on the insulating base 1 between the third ground extension section 114 and the first power terminal 17. The third differential signal terminal 18 has a third differential signal soldering section 181 at an end between the first power soldering section 171 and the third ground soldering section 117.

There is a metallic fourth differential signal terminal 19 on the insulating base 1 between the first power terminal 17 and the third differential signal terminal 18. The fourth differential signal terminal 19 has a fourth differential signal soldering section 191 at an end between the third differential signal soldering section 181 and the first power soldering section 171.

There is a shielding casing 2 enclosing the insulating base 1.

The integration to the insulating base 1 by the ground terminal 11, the first signal terminal 12, the second signal terminal 13, the fourth ground terminal 14, the first differential signal terminal 15, the second differential signal terminal 16, the first power terminal 17, the third differential signal terminal 18, and the fourth differential signal terminal 19 can be insert or plugin, and these terminals can be commonly connected to a printed circuit board by single-row SMT, single-row DIP, two-row SMT, two-row DIP, upward bending and extension, downward bending and extension, continuous bending and extension. For upward bending and extension, it can be flatly laid, raised, vertical, or upright. For downward bending and extension, it can be flatly laid or raised. For continuous bending and extension, it can be forward or backward (FIG. 2A depicts the USB female connector in the style of downward bending and extension.

In addition, the ground terminal 11, the first differential signal terminal 15, the second differential signal terminal 16, the third differential signal terminal 18, and the fourth differential signal terminal 19 are structured as stable plates. The fourth ground terminal 14, the first signal terminal 12, the second signal terminal 13, and the first power terminal 17 are flexibly structured.

Furthermore, the ground terminal 11, the first differential signal terminal 15, the second differential signal terminal 16, the third differential signal terminal 18, and the fourth differential signal terminal 19 are positioned lower than the fourth ground terminal 14, the first signal terminal 12, the second signal terminal 13, and the first power terminal 17. In the meantime, the ground terminal 11, the first differential signal terminal 15, the second differential signal terminal 16, the third differential signal terminal 18, and the fourth differential signal terminal 19 are positioned beyond the fourth ground terminal 14, the first signal terminal 12, the second signal terminal 13, and the first power terminal 17.

Figure 3:
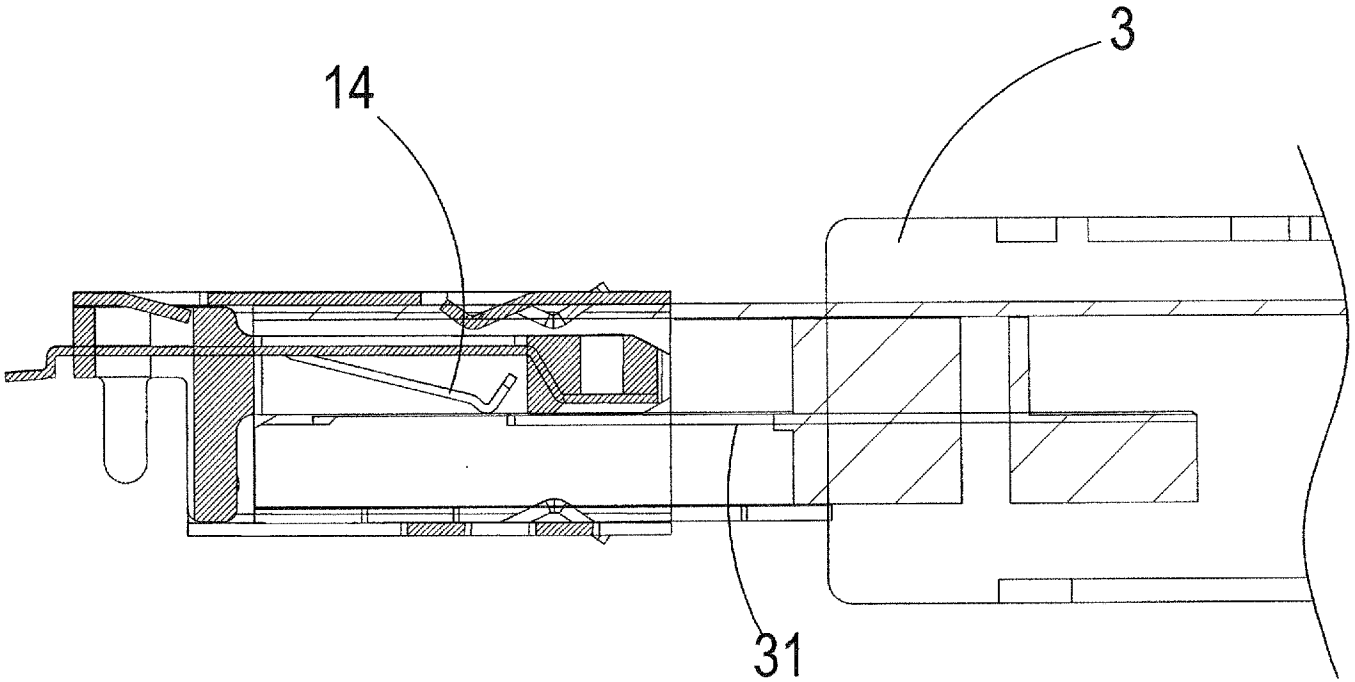
FIG. 3 is a schematic sectional diagram showing a USB male connector plugged into the USB female connector of FIG. 1.

Together with FIGS. 1 to 3, the operation of the USB female connector of the present embodiment is described as follows. As illustrated, when a USB male connector 3 is plugged into the insulating base 1 of the USB female connector, a base board 31 of the USB male connector 3 has its differential signal terminals conducted to the ground terminal 11, the first signal terminal 12, the second signal terminal 13, the fourth ground terminal 14, the first differential signal terminal 15, the second differential signal terminal 16, the first power terminal 17, the third differential signal terminal 18, and the fourth differential signal terminal 19. In the meantime, the first, second, and third ground extension sections 112, 113, and 114 forked from the ground terminal 11 are effectively isolated, and the crosstalk on the first, second, third, and fourth differential signal terminals 15, 16, 18, and 19 from the first and second signal terminals 12 and 13 is effectively resolved.

Figure 4:
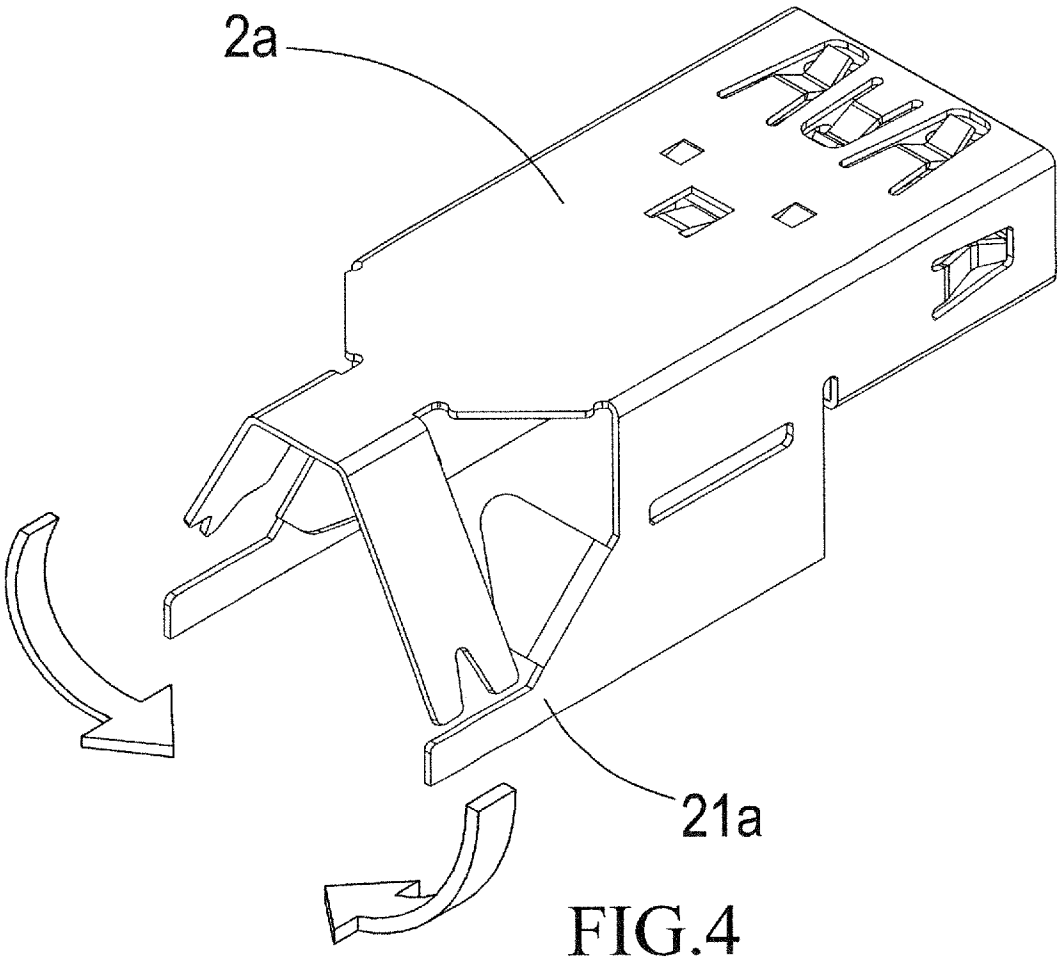
FIG. 4 is a perspective diagram showing a shielding casing of a USB female connector according to a second embodiment of the present invention before an opening of the shielding casing is formed.
Figure 5:
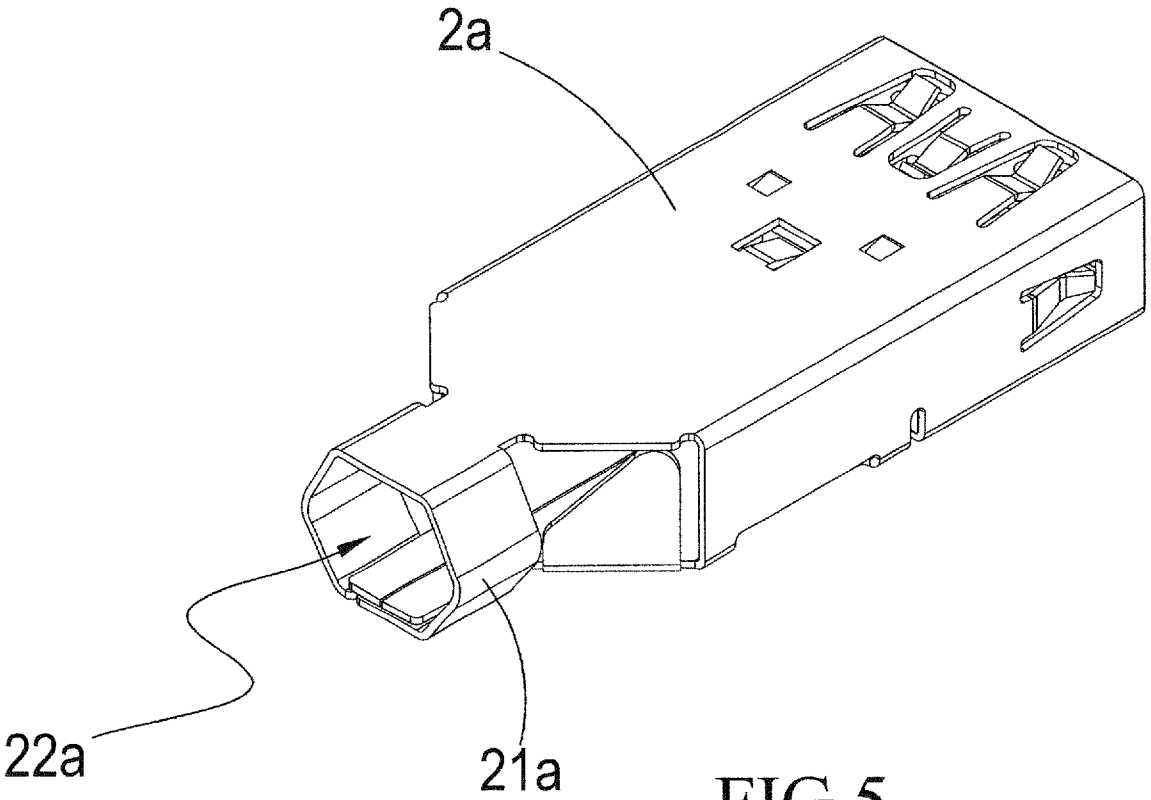
FIG. 5 is a perspective diagram showing the shielding casing of the USB of FIG. 4 after the opening of the shielding casing is formed.
Figure 6:
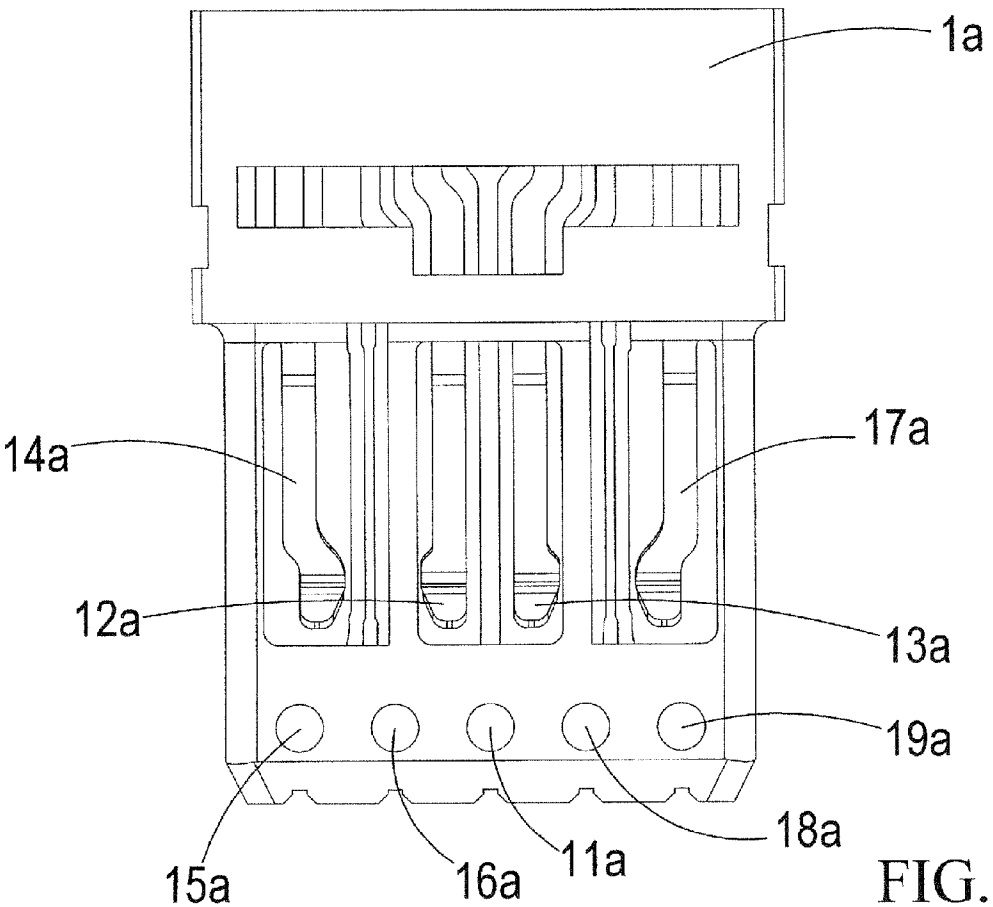
FIG. 6 is a schematic diagram showing the terminal layout of the USB female connector of FIG. 4.

A USB female connector according to a second embodiment of the present invention is depicted in FIGS. 4, 5, and 6. As a cable connector, the USB female connector has an insulating base 1*a* and, on the insulating base 1*a*, there are a ground terminal 11a, a first signal terminal 12*a*, a second signal terminal 13*a*, a fourth ground terminal 14*a*, a first differential signal terminal 15*a*, a second differential signal terminal 16*a*, a first power terminal 17*a*, a third differential signal terminal 18*a*, and a fourth differential signal terminal 19*a*. The insulating base 1 is enclosed in an integrally formed shielding casing 2*a* which has an opening 22*a* away from the insulating base 1*a* surrounded by bended side walls 21*a*. When the shielding case 2*a* is sleeved, an end is wrapped in a sleeve and the other end is exposed from the sleeve. During assembly, the ground terminal 11*a*, the first signal terminal 12*a*, the second signal terminal 13*a*, the fourth ground terminal 14*a*, the first differential signal terminal 15*a*, the second differential signal terminal 16*a*, the first power terminal 17*a*, the third differential signal terminal 18*a*, and the fourth differential signal terminal 19*a* are first connected to electrical wires by single-sided hot-bar soldering, single-sided spot soldering, single-sided tension soldering, single-row hot-bar soldering, single-row spot soldering, single-row tension soldering, two-sided hot-bar soldering, two-sided spot soldering, two-sided tension soldering, two-row hot-bar soldering, two-row sport soldering, two-row tension soldering, etc. Then, the terminals and wires are housed in the shielding casing 2*a* towards or away from the opening 22*a*. The side walls 21*a* are then bended to wrap and lock the electrical wires. The process is simple, takes less production time, and as such requires a reduced cost.

Figure 7:
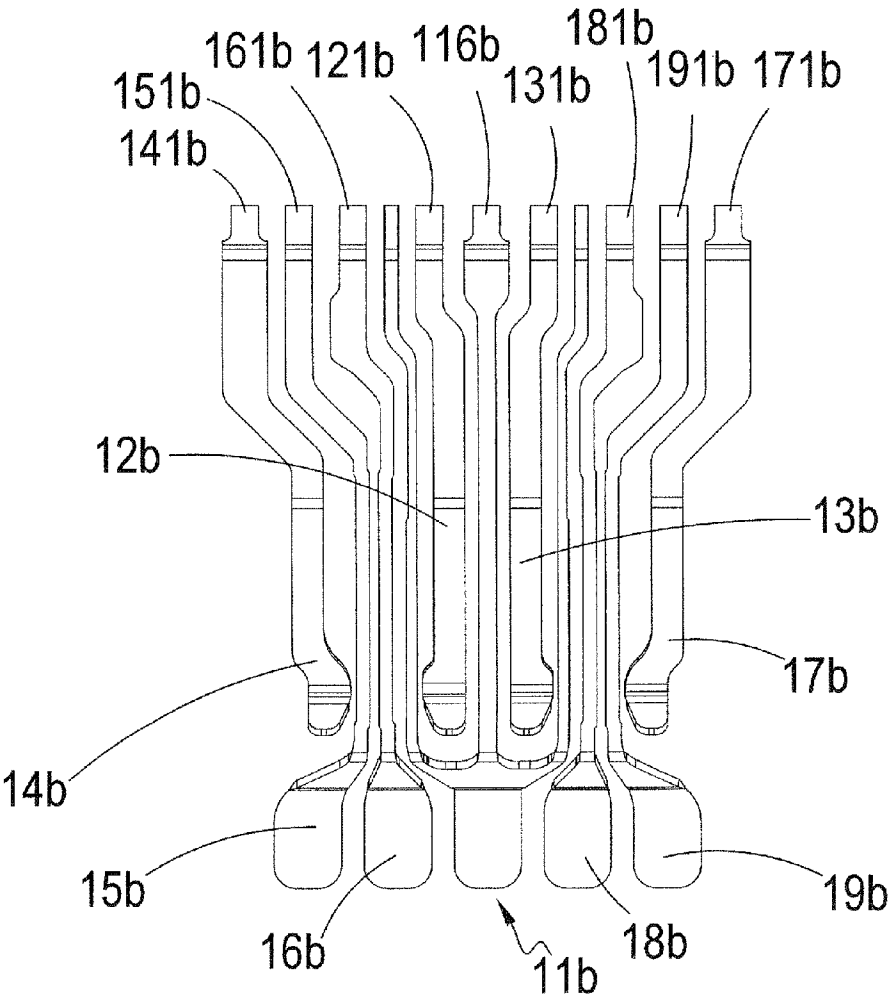
FIG. 7 is a schematic diagram showing the terminal layout of a USB female connector according to a third embodiment of the present invention.

A USB female connector according to a third embodiment of the present invention is depicted in FIG. 7. As illustrated, the USB female connector contains the following components.

There is a metallic ground terminal 11*b* on the insulating base 1. The ground terminal 11*b* is different from the previous embodiments in that it has a single second ground soldering section 116*b*.

There is a metallic first signal terminal 12*b* on the insulating base 1 having a first signal soldering section 121*b* at a side of the second ground soldering section 116*b*.

There is a metallic second signal terminal 13*b* on the insulating base 1 having a second signal soldering section 131*b* at the other side of the second ground soldering section 116*b*.

There is a metallic fourth ground terminal 14*b* on the insulating base 1 having a fourth ground soldering section 141*b* at an end parallel to the first signal soldering section 121*b*.

There is a metallic first differential signal terminal 15*b* on the insulating base 1 having a first differential signal soldering section 151*b* at an end between the fourth ground soldering section 141*b* and the first signal soldering section 121*b*.

There is a metallic second differential signal terminal 16*b* on the insulating base 1 having a second differential signal soldering section 161*b* at an end between the first differential signal soldering section 151*b* and the first signal soldering section 121*b*.

There is a metallic first power terminal 17*b* on the insulating base 1 having a first power soldering section 171*b* at an end parallel to the second signal soldering section 131*b*.

There is a metallic third differential signal terminal 18*b* on the insulating base 1 having a third differential signal soldering section 181*b* at an end between the first power soldering section 171*b* and the second signal soldering section 131*b*.

There is a metallic fourth differential signal terminal 19*b* on the insulating base 1 having a fourth differential signal soldering section 191*b* at an end between the third differential signal soldering section 181*b* and the first power soldering section 171*b*.

As described above, the USB female connector of the present invention can have 11 soldering sections (i.e., 11 pins) or 9 soldering sections (i.e., 9 pins). For both embodiments, the crosstalk on the first, second, third, and fourth differential signal terminals from the first and second signal terminals is effectively resolved through the first, second, and third ground extension sections forked from the ground terminal (not marked in FIG. 7).

Compared to the prior arts, the present invention has the following advantages.

Firstly, the crosstalk on the first, second, third, and fourth differential signal terminals 15, 16, 18, and 19 from the first and second signal terminals 12 and 13 is effectively resolved through the first, second, and third ground extension sections 112, 113, and 114 forked from the ground terminal 11. Also this advantage is achieved under the same space limitation.

Secondly, reduced production time and enhanced efficiency are achieved by integrally forming an opening 22*a* at an end of the shielding casing 2*a*.

Thirdly, the USB female connector of the present invention has a thin width, a short length, a small form factor, a reduced material consumption, a simple production process, an enhanced high-frequency characteristic, a simplified structure, a better quality, and a wider applicability.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A USB female connector, comprising a metallic ground terminal having a ground contact section at an end and, from the ground contact section, extended toward the other end and forked into a first ground extension section, a second ground extension section, and a third ground extension section;

a metallic first signal terminal between the first and second ground extension sections;

a metallic second signal terminal between the second and third ground extension sections;

a metallic fourth ground terminal at the side and parallel to the first signal terminal;

a metallic first differential signal terminal between the first ground extension section and the fourth ground terminal;

a metallic second differential signal terminal between the first ground extension section and the first differential signal terminal;

a metallic first power terminal at the side and parallel to the second signal terminal;

a metallic third differential signal terminal between the third ground extension section and the first power terminal; and a metallic fourth differential signal terminal between the first power terminal and the third differential signal terminal.

2. A USB female connector, comprising an insulating base;

a metallic ground terminal on the insulating base having a ground contact section at an end of the insulating base and, from the ground contact section, extended toward the other end and forked into a first ground extension section, a second ground extension section, and a third ground extension section;

a metallic first signal terminal on the insulating base between the first and second ground extension sections;

a metallic second signal terminal on the insulating base between the second and third ground extension sections;

a metallic fourth ground terminal on the insulating base at the side and parallel to the first signal terminal;

a metallic first differential signal terminal on the insulating base between the first ground extension section and the fourth ground terminal;

a metallic second differential signal terminal on the insulating base between the first ground extension section and the first differential signal terminal;

a metallic first power terminal on the insulating base at the side and parallel to the second signal terminal;

a metallic third differential signal terminal on the insulating base between the third ground extension section and the first power terminal;

a metallic fourth differential signal terminal on the insulating base between the first power terminal and the third differential signal terminal; and a shielding casing enclosing the insulating base.

3. The female USB connector according to claim 1, wherein the ground terminal, the first signal terminal, the second signal terminal, the fourth ground terminal, the first differential signal terminal, the second differential signal terminal, the first power terminal, the third differential signal terminal, and the fourth differential signal terminal are commonly connected to a printed circuit board by one of single-row SMT, single-row DIP, two-row SMT, two-row DIP, upward bending and extension, downward bending and extension, and continuous bending and extension; for upward bending and extension, the connection is one of flatly laid, raised, vertical, and upright; for downward bending and extension, the connection is one of flatly laid and raised; and, for continuous bending and extension, the connection is one of forward and backward.

4. The female USB connector according to claim 2, wherein the ground terminal, the first signal terminal, the second signal terminal, the fourth ground terminal, the first differential signal terminal, the second differential signal terminal, the first power terminal, the third differential signal terminal, and the fourth differential signal terminal are commonly connected to a printed circuit board by one of single-row SMT, single-row DIP, two-row SMT, two-row DIP, upward bending and extension, downward bending and extension, and continuous bending and extension; for upward bending and extension, the connection is one of flatly laid, raised, vertical, and upright; for downward bending and extension, the connection is one of flatly laid and raised; and, for continuous bending and extension, the connection is one of forward and backward.

5. The female USB connector according to claim 1, wherein the integration to the insulating base by the ground terminal, the first signal terminal, the second signal terminal, the fourth ground terminal, the first differential signal terminal, the second differential signal terminal, the first power terminal, the third differential signal terminal, and the fourth differential signal terminal is one of insert and plugin.

6. The female USB connector according to claim 1, wherein the ground terminal, the first differential signal terminal, the second differential signal terminal, the third differential signal terminal, and the fourth differential signal terminal are structured as stable plates; and The fourth ground terminal, the first signal terminal, the second signal terminal, and the first power terminal are flexibly structured.

7. The female USB connector according to claim 2, wherein the ground terminal, the first differential signal terminal, the second differential signal terminal, the third differential signal terminal, and the fourth differential signal terminal are structured as stable plates; and The fourth ground terminal, the first signal terminal, the second signal terminal, and the first power terminal are flexibly structured.

8. The female USB connector according to claim 1, wherein the insulating base is one of a printed circuit board, a 3D circuit board, and an insulating plastic member.

9. The female USB connector according to claim 1, wherein the ground terminal, the first signal terminal, the second signal terminal, the fourth ground terminal, the first differential signal terminal, the second differential signal terminal, the first power terminal, the third differential signal terminal, and the fourth differential signal terminal are connected to electrical wires by one of single-sided hot-bar soldering, single-sided spot soldering, single-sided tension soldering, single-row hot-bar soldering, single-row spot soldering, single-row tension soldering, two-sided hot-bar soldering, two-sided spot soldering, two-sided tension soldering, two-row hot-bar soldering, two-row sport soldering, and two-row tension soldering.

10. The female USB connector according to claim 2, wherein the ground terminal, the first signal terminal, the second signal terminal, the fourth ground terminal, the first differential signal terminal, the second differential signal terminal, the first power terminal, the third differential signal terminal, and the fourth differential signal terminal are connected to electrical wires by one of single-sided hot-bar soldering, single-sided spot soldering, single-sided tension soldering, single-row hot-bar soldering, single-row spot soldering, single-row tension soldering, two-sided hot-bar soldering, two-sided spot soldering, two-sided tension soldering, two-row hot-bar soldering, two-row sport soldering, and two-row tension soldering.

11. The female USB connector according to claim 1, wherein the ground terminal, the first differential signal terminal, the second differential signal terminal, the third differential signal terminal, and the fourth differential signal terminal are positioned lower than the fourth ground terminal, the first signal terminal, the second signal terminal, and the first power terminal; and the ground terminal, the first differential signal terminal, the second differential signal terminal, the third differential signal terminal, and the fourth differential signal terminal are positioned beyond the fourth ground terminal, the first signal terminal, the second signal terminal, and the first power terminal.

12. The female USB connector according to claim 2, wherein the ground terminal, the first differential signal terminal, the second differential signal terminal, the third differential signal terminal, and the fourth differential signal terminal are positioned lower than the fourth ground terminal, the first signal terminal, the second signal terminal, and the first power terminal; and the ground terminal, the first differential signal terminal, the second differential signal terminal, the third differential signal terminal, and the fourth differential signal terminal are positioned beyond the fourth ground terminal, the first signal terminal, the second signal terminal, and the first power terminal.

13. A USB female connector, comprising a metallic ground terminal having a first ground soldering section, a second ground soldering section, and a third ground soldering section at one end;

a metallic first signal terminal having a first signal soldering section at an end between the first and second ground soldering sections;

a metallic second signal terminal having a second signal soldering section at an end between the second and third ground soldering sections;

a metallic fourth ground terminal a fourth ground soldering section at an end parallel to the first ground soldering section;

a metallic first differential signal terminal having a first differential signal soldering section at an end between the fourth ground soldering section and the first ground soldering section;

a metallic second differential signal terminal having a second differential signal soldering section at an end between the first differential signal soldering section and the first ground soldering section;

a metallic first power terminal having a first power soldering section at an end parallel to the third ground soldering section;

a metallic third differential signal terminal having a third differential signal soldering section at an end between the first power soldering section and the third ground soldering section; and a metallic fourth differential signal terminal having a fourth differential signal soldering section at an end between the third differential signal soldering section and the first power soldering section.

14. A USB female connector, comprising a metallic ground terminal having a second ground soldering section at one end;

a metallic first signal terminal having a first signal soldering section at a side of the second ground soldering section;

a metallic second signal terminal having a second signal soldering section at the other side of the second ground soldering section;

a metallic fourth ground terminal a fourth ground soldering section at an end parallel to the first signal soldering section;

a metallic first differential signal terminal having a first differential signal soldering section at an end between the fourth ground soldering section and the first signal soldering section;

a metallic second differential signal terminal having a second differential signal soldering section at an end between the first differential signal soldering section and the first signal soldering section;

a metallic first power terminal having a first power soldering section at an end parallel to the second signal soldering section;

a metallic third differential signal terminal having a third differential signal soldering section at an end between the first power soldering section and the second signal soldering section; and a metallic fourth differential signal terminal having a fourth differential signal soldering section at an end between the third differential signal soldering section and the first power soldering section.

* * * * *